United States Patent [19]

Timmer

[11] 4,083,624

[45] Apr. 11, 1978

[54] TERMINAL CLAMP

[76] Inventor: Henry Timmer, 2705 Rockhill Dr., Grand Rapids, Mich. 49505

[21] Appl. No.: 760,736

[22] Filed: Jan. 19, 1977

[51] Int. Cl.[2] ..... H01R 11/26

[52] U.S. Cl. ..... 339/264 R; 269/249

[58] Field of Search ..... 339/108 R, 109, 110, 339/264, 277 R; 269/249

[56] References Cited

U.S. PATENT DOCUMENTS

| | | | |
|---|---|---|---|
| 809,882 | 1/1906 | Wrigley | 269/249 |
| 2,313,361 | 3/1943 | Richards | 339/264 R |
| 2,396,823 | 3/1946 | Burbank et al. | 269/249 |
| 2,420,895 | 5/1947 | Merriman | 339/264 R |
| 2,430,458 | 11/1947 | Farrell | 269/249 |

*Primary Examiner*—Joseph H. McGlynn
*Attorney, Agent, or Firm*—Glenn B. Morse

[57] ABSTRACT

A C-clamp has a bearing pad formed on a plug having a body portion removably received within a bore in one extremity of the clamp frame. The bore is coaxial with the clamping rod movably mounted in the opposite extremity of the frame. The bore is intersected by a slot receiving a cable connector, with the usual hole in the connector normally traversed by the plug, and in firm electrical contact therewith.

The clamp is also preferably provided with a tubular member having the exterior thereof in threaded engagement with the opposite frame extremity. The clamping shaft is slidably received in the tubular member, and a one-way rotative interlock is provided between the shaft and the tubular member in the direction to induce movement of the tubular member toward the pad in the thread system. A brake is incorporated for restraining the rotation between the tubular member and the frame.

4 Claims, 11 Drawing Figures

TERMINAL CLAMP

BACKGROUND OF THE INVENTION

So called C-clamps have been in use since ancient times. The usual modern form of the device involves a C-shaped frame, with some form of a bearing pad formed or mounted at one extremity of the frame. The opposite extremity will usually have a clamping rod movably mounted in a direction toward and away from the pad to generate clamping pressure. This rod is often threaded along its entire length, but one known modification has a rapid-traverse arrangement in which the rod is slidably mounted in a collar having threaded engagement with the frame. This form of the unit will have a one-way rotative interlock between the shaft and the threaded collar such that rotation in this direction corresponds to movement of the collar in the thread system to carry the shaft toward the pressure pad.

The C-clamp has been applied to a somewhat different field of use relatively recently. In electrical welding procedures, it is necessary to provide a return path for the current from the piece being welded to the welding generator. This has sometimes been accomplished by simply applying a C-clamp to the welded piece, with a cable terminal entrapped under grip of the C-clamp so that the terminal bears solidly against the welded member. Sometimes the clamp is used to hold a couple of members being welded together, while serving the additional function of securing the cable terminal in position to receive the return current. To facilitate either of these arrangements, there has been occasional use of semi-permanent securing of the cable terminal to the clamp, with a nut engaging a bolt-like projection. This makes a very handy arrangement when the clamp is used exclusively for a welding terminal, but causes too much inconvenience whenever it is desirable to use the clamp for some function unrelated to welding. It is highly desirable to provide quick-disconnect arrangements both with respect to the cable terminal and also with regard to the engagement and disengagement of the clamping mechanism. The rotative interlock previously discussed has shown a tendency to seize to the extent that back-rotation to release clamping pressure generates a corresponding tendency for the threaded sleeve to move to the extremity of its thread system before the rotative interlock is released. This eliminates some of the desirable features of the rapid-traverse disengagement and adjustability.

SUMMARY OF THE INVENTION

The new C-clamp has a bore in one extremity of the frame removably receiving the body portion of a plug that provides the pressure pad at one end of the plug. The frame is slotted in such a manner that the bore is intersected for receiving the end of a conventional cable terminal, with the usual hole in the terminal being traversed by the body portion of this plug. The terminal is thus quickly disengaged by simply knocking the plug in a direction to move it into the gap of the clamp frame to sufficient extent that it no longer traverses the hole in the cable terminal, following which the terminal is freely withdrawn. With the terminal engaged, clamping pressure is normally transferred directly from the pad through the plug to the cable terminal to maintain the optimum electrical contact conditions. To complete the quick-disconnect features of this arrangement, the rapid-traverse arrangement is incorporated with the addition of a brake arrangement operative to restrain relative rotation between the frame and the threaded sleeve normally carrying the clamping shaft with a one-way rotative interlock. This arrangement has the effect of instantly disengaging the rotative interlock to the point that the shaft is free to slide without rotation of the threaded sleeve.

DESCRIPTION OF THE PREFERRED EMBODIMENTS

Figure 2:
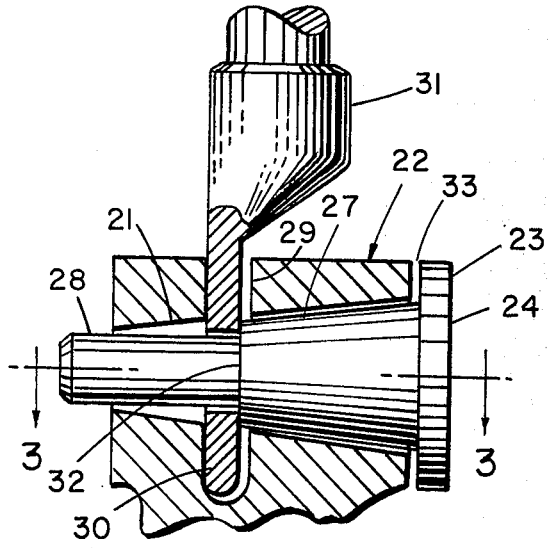
FIG. 2 is a section on the plane 2—2 of FIG. 3.
Figure 3:
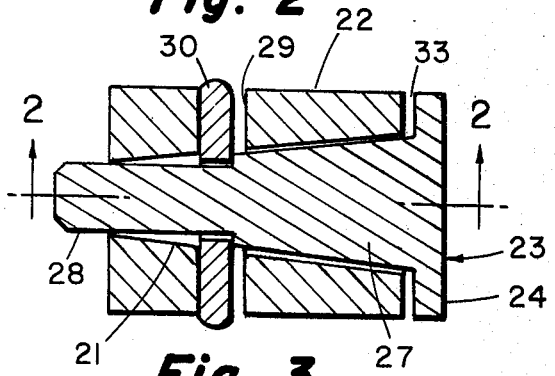
FIG. 3 is a section on the plane 3—3 of FIG. 1.

Referring to Sheet 1 of the drawings, the frame 20 of the C-clamp has a bore 21 in the extremity 22 receiving the plug 23, which provides the head 24 functioning as a pressure pad transferring force applied by the clamping rod 25 through the articulating pressure foot 26. The plug 23 has a body portion 27 traversing the bore 21, with the extension 28 continuing beyond the extremity 22 of the frame so that the plug can be struck at that end to knock it to the right, as shown in FIGS. 2 and 3, for disengaging the plug from its assembled position. A slot 29 in extremity 22 intersects the bore 21, and provides for the insertion of the end 30 of the conventional cable connector 31. Movement of the plug 23 to the right to a sufficient degree that it does not intersect the slot 29 will obviously free the connector 31 from engagement with the clamp.

Figure 4:
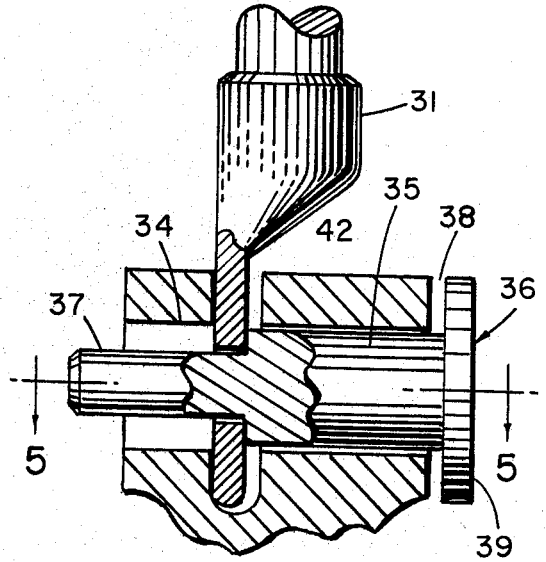
FIG. 4 is a section corresponding to FIG. 3, but illustrating a modified form of the invention.

The body portion 27 is provided with a shoulder 32 normally bearing directly on the portion 30 of the connector for the direct transfer of clamping pressure at this point to generate the best possible electrical conductivity. A degree of clearance is provided under the head 24, as shown at 33, to assure this relationship. In the absence of the connector 31, the tapered configuration of the bore 21 is provided to give the most solid locating relationship between the plug and the clamp frame. Under these circumstances, it is preferable that the bearing pressure be transferred at the tapered body portion, with some degree of clearance still remaining at 33. FIG. 4 shows a modified form of the invention in which the bore 34 is cylindrical, with the body portion 35 of the plug 36 being provided with slip-fit clearance within this bore. The advantage of this arrangement centers primarily in the manufacturing processes involved, as the provision of a tapered bore as shown in FIGS. 2 and 3 requires the insertion of reaming devices within the gap of the C-clamp, and the subsequent coupling of them to a driving mechanism capable of engaging the reamer after it has been slipped through the rough opening which will later become the bore 21. In FIG. 4, the entire formation of the bore 34 can take place from the left. The clearances and proportions of the components are selected to assure that clamping pressure is directly applied to the connector 31 by the body portion of the plug. The length of the extension 37 is sufficient to provide the knock-out feature previously discussed. In the FIG. 4 arrangement, the clearance at 38 will disappear on removal of the cable connector 31, so that clamping pressure is transferred at the underside of the head 39 of the plug 36.

Figure 5:
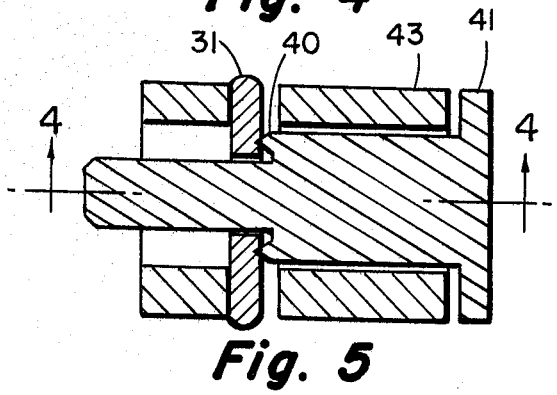
FIG. 5 is a section on the plane 5—5 of FIG. 4.

FIG. 5 is similar to FIG. 4, with the exception that the shoulder 40 of the plug 41 is in the form of an annular ridge that is triangular in cross-section, in order to give a solid bite on the cable connector 31. It is common knowledge that the copper-alloy materials normally used for the connector 31 have a tendency to develop a coating of copper oxide on the surface, which has a relatively high electrical resistance. The configuration shown to FIG. 5 will have a tendency to scratch through this coating, and thus generate the best contact conditions. The clamp frames 42 and 43 appearing in FIGS. 4 and 5, respectively, are otherwise similar to the frame 20 of FIG. 1.

Figure 1:
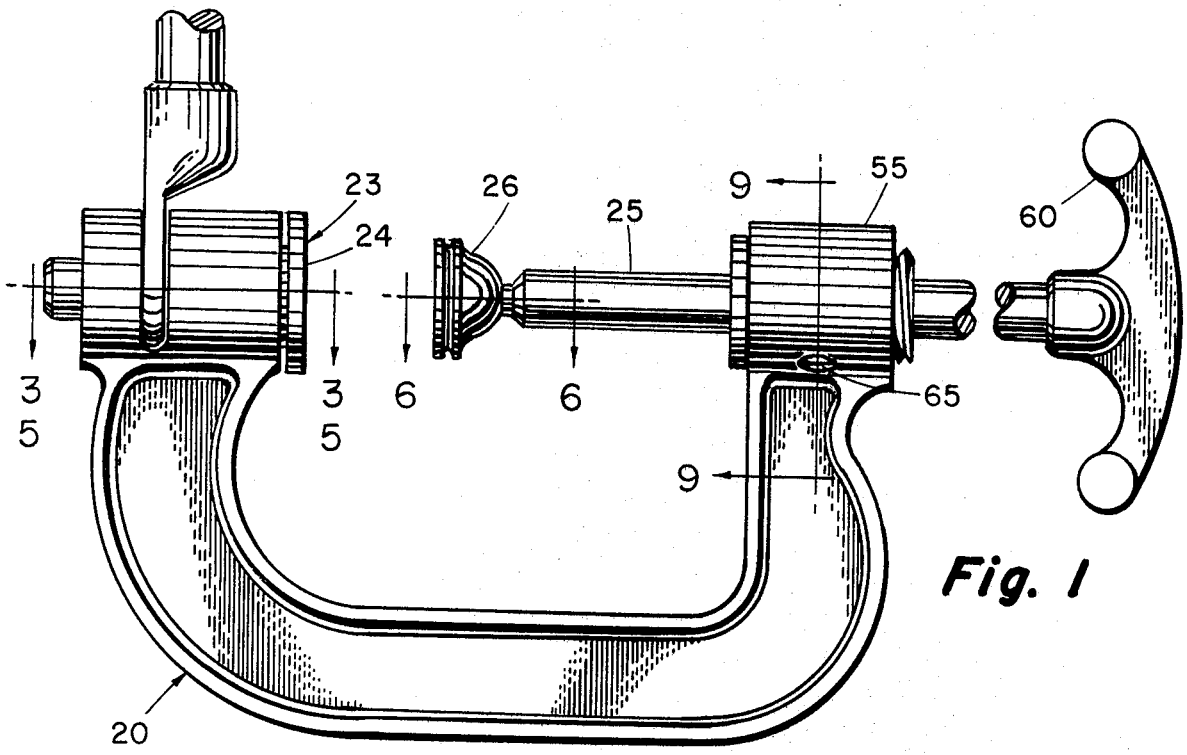
FIG. 1 is a plan view showing a terminal clamp incorporating the present invention, with a cable terminal in the engaged position.
Figure 6:
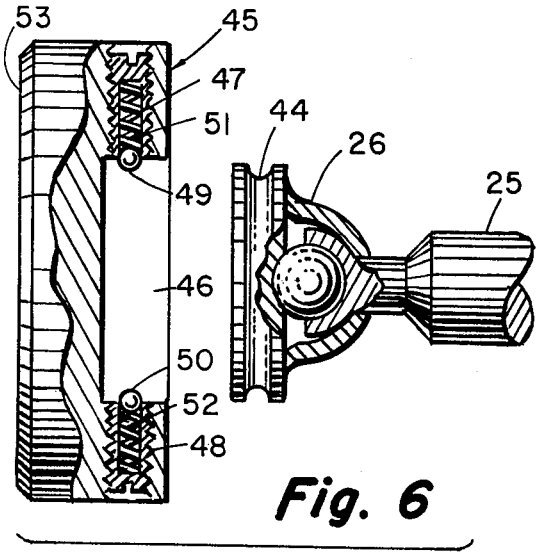
FIG. 6 is an exploded view on an enlarged scale showing an attachment to the clamping foot of the device.
Figure 7:
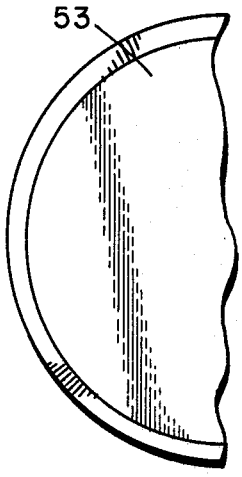
FIGS. 7 and 8 show alternative surface configurations for the bearing face of the attachment illustrated in FIG. 6.
Figure 8:
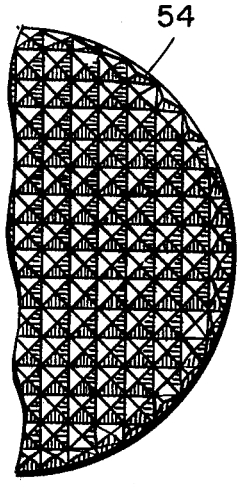

Referring to Sheet 2 of the drawings, FIG. 6 illustrates a removable attachment for the articulating clamping foot 26 appearing in FIG. 1. This member is grooved peripherally as shown at 44. The bearing attachment 45 has a counterbore 46 capable of receiving the outside diameter of the pressure foot 26, and opposite sides of the attachment 45 are provided with devices commonly known to tool and die makers as "breakers" indicated at 47 and 48. These are essentially set-screw type units received in threaded holes in the attachment 45, as shown, and containing movable balls 49 and 50 biased outwardly to the position shown in FIG. 6 by internal compression springs 51 and 52, respectively. These units are conventional. FIG. 7 shows a form of attachment 45 in which the bearing surface 53 is coplanar, and FIG. 8 illustrates a cross-serrated pattern 54 providing for an increased gripping action where surface conditions are such that the marking is not a problem.

Figure 9:
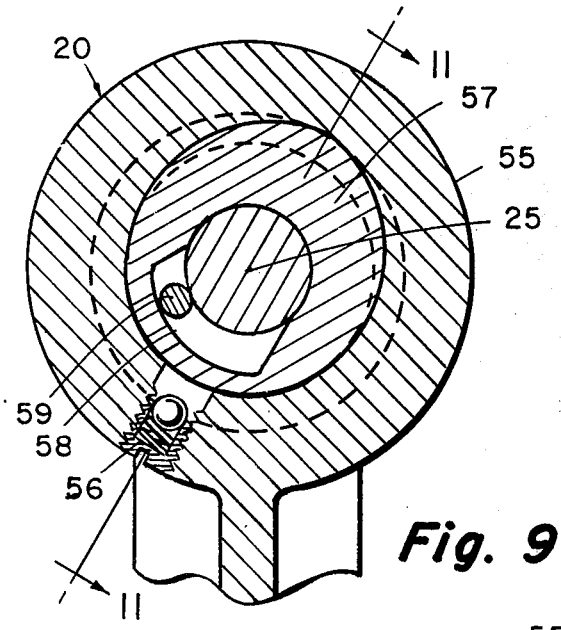
FIG. 9 is a section on the plane 9—9 of FIG. 1, on an enlarged scale.
Figure 10:
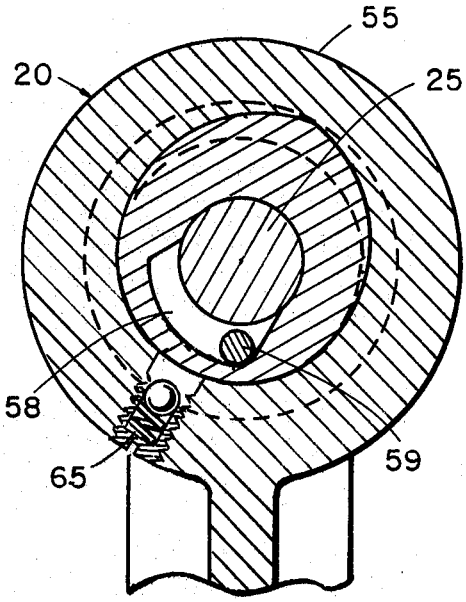
FIG. 10 is similar to FIG. 9, but showing the rotative interlock in a free position.
Figure 11:
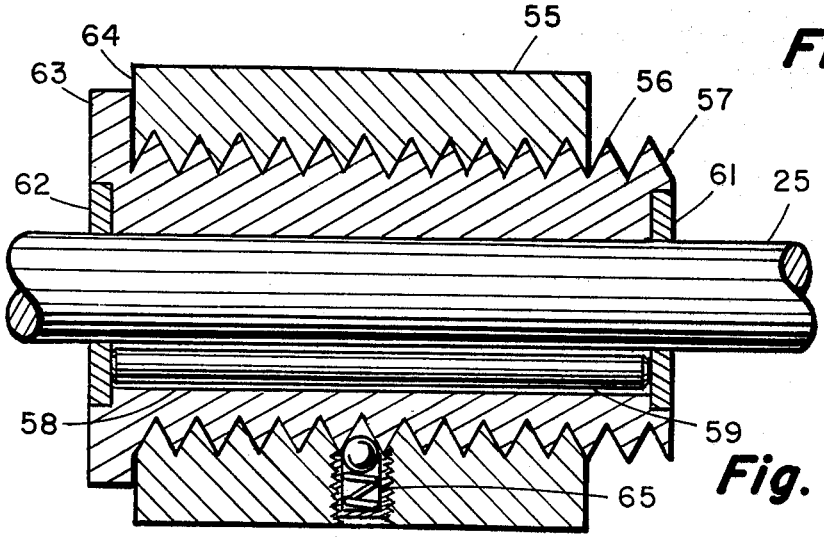
FIG. 11 is a section on the plane 11—11 of FIG. 9.

Referring to FIGS. 9–11, the extremity 55 of the clamp frame 20 opposite from the pressure pad 24 is provided with a threaded bore receiving the threaded exterior 56 of the tubular member 57. This member has a central passage slidably receiving the pressure shaft 25, and having a lateral extension forming a cam surface indicated at 58 which entraps the locking roller 59 on clockwise rotation of the shaft 25 with respect to the frame, as viewed in FIG. 9. The resulting frictional interlock of this arrangement is discussed in the Burbank, et al. U.S. Pat. No. 2,396,823, and results in the rotation of the tubular member 57 with the shaft 25 under torque applied to the handle 60. Opposite (counterclockwise, as shown in FIG. 10) relative rotation between the shaft 25 and the frame 20 will result in placement of the components in a position where the roller 59 is no longer in jamming relationship between the shaft 25 and the cam surface 58, thus leaving the shaft free to slide within the tubular member 57 to affect rapid-traverse and disengagement of the clamp, and also provide for quick re-engagement with another member. The cam surface 58, and also the cylindrical surface receiving the shaft 25, are preferably provided by a broaching operation establishing these surfaces throughout the length of the member 57. To confine the roller 59, it is preferable to insert end washers as shown at 61 and 62, which are pressed into appropriate recesses in the ends of the tubular member 57.

To avoid the necessity of having to bring the assembly fully to the FIG. 11 position, where the end flange 63 on the tubular member 57 engages the surface 64 of the frame in order to affect disengagement of the rotative interlock, the brake unit shown at 65 is incorporated at the position shown in FIG. 1. This unit is preferably the same type as that discussed in connection with FIG. 6. The screw configuration provides a convenient degree of adjustability of the drag resulting from the engagement of the ball end with the thread grooves, in the relationship shown in FIG. 11. The adjustment should provide a sufficient degree of drag to assure that back rotation of the handle 10 will first result in disengagement of the jamming action illustrated in FIG. 9. Since the threaded member 57 is thus not normally back-rotated to the FIG. 11 position by the handle 60, it may be desirable to apply knurling to the outer periphery of the flange 63 so that it can be manipulated directly by hand, when necessary.

I claim:

1. An electrical terminal clamp having a C-shaped frame, and having a bearing pad mounted at one extremity of said frame, on the side thereof nearest the opposite extremity thereof and also having a clamping shaft mounted at the said opposite extremity of said frame for movement toward and away from said pad along an axis, wherein the improvement comprises:

means forming a bore in said one frame extremity along said axis, and a slot in said extremity transverse to, and intersecting, said bore;

a plug having a head providing said pad and a body portion receivable in and normally transversing said bore; and a coupling member normally secured to an electrical conductor, and having a portion receivable in said slot, said portion having an aperture normally receiving said body portion.

2. A clamp as defined in claim 1, wherein said body portion has a shoulder normally bearing on said coupling member portion to transmit force generated by said clamping shaft.

3. A clamp as defined in claim 1, wherein said bore extends through said one frame extremity, and said body portion normally extends beyond the end of said bore opposite from said pad.

4. A clamp as defined in claim 1, wherein said bore is tapered, with the major diameter of said body portion having a corresponding taper.

* * * * *